US009211446B2

(12) United States Patent
Berggren

(10) Patent No.: US 9,211,446 B2
(45) Date of Patent: Dec. 15, 2015

(54) SPORT BALL BLADDER WITH A POCKET

(71) Applicant: NIKE, Inc., Beaverton, OR (US)

(72) Inventor: Scott R. Berggren, Portland, OR (US)

(73) Assignee: Nike, Inc., Beaverton, OR (US)

( * ) Notice: Subject to any disclaimer, the term of this patent is extended or adjusted under 35 U.S.C. 154(b) by 221 days.

(21) Appl. No.: 13/840,350

(22) Filed: Mar. 15, 2013

(65) Prior Publication Data

US 2014/0274498 A1 Sep. 18, 2014

(51) Int. Cl.

| | |
|---|---|
| ***A63B 43/00*** | (2006.01) |
| ***A63B 45/00*** | (2006.01) |
| ***A63B 41/10*** | (2006.01) |
| ***A63B 41/02*** | (2006.01) |
| *A63B 71/06* | (2006.01) |
| *A63B 41/00* | (2006.01) |

(52) U.S. Cl.

CPC ..... *A63B 43/004* (2013.01); *A63B 41/02* (2013.01); *A63B 41/10* (2013.01); *A63B 43/00* (2013.01); *A63B 45/00* (2013.01); *A63B 71/0605* (2013.01); *A63B 2041/005* (2013.01); *A63B 2220/12* (2013.01); *A63B 2220/13* (2013.01); *A63B 2220/30* (2013.01); *A63B 2220/35* (2013.01); *A63B 2220/40* (2013.01); *A63B 2220/56* (2013.01); *A63B 2220/73* (2013.01); *A63B 2220/807* (2013.01); *A63B 2220/833* (2013.01); *A63B 2225/54* (2013.01); *Y10T 29/49885* (2015.01)

(58) Field of Classification Search

CPC ..... A63B 43/00; A63B 43/004; A63B 43/06; A63B 41/02; A63B 2041/005; A63B 2220/13; A63B 2220/12; A63B 2220/30; A63B 2220/833

See application file for complete search history.

(56) References Cited

U.S. PATENT DOCUMENTS

| | | | | |
|---|---|---|---|---|
| 4,479,649 | A * | 10/1984 | Newcomb et al. | 473/570 |
| 4,577,865 | A * | 3/1986 | Shishido | 473/570 |
| 4,595,200 | A * | 6/1986 | Shishido | 473/570 |
| 5,236,383 | A * | 8/1993 | Connelly | 446/219 |
| 5,403,000 | A * | 4/1995 | Woosley | 473/447 |
| 5,609,411 | A * | 3/1997 | Wang | 362/234 |
| 5,954,603 | A * | 9/1999 | Chursinoff | 473/594 |
| 6,059,676 | A * | 5/2000 | Seymour et al. | 473/570 |
| 8,517,870 | B2 * | 8/2013 | Crowley et al. | 473/570 |
| 2003/0224885 | A1 * | 12/2003 | Leal et al. | 473/570 |

(Continued)

FOREIGN PATENT DOCUMENTS

| | | | |
|---|---|---|---|
| EP | 2 724 756 | A1 | 4/2014 |
| WO | 2004/026411 | A1 | 4/2004 |
| WO | 2014/151405 | A2 | 9/2014 |

OTHER PUBLICATIONS

International Search Report and Written Opinion mailed Oct. 1, 2014 in PCT/US2014/025662.

*Primary Examiner* — Steven Wong
(74) *Attorney, Agent, or Firm* — Quinn Law Group, PLLC

(57) ABSTRACT

A sport ball may include a casing, a bladder, and a component. The casing forms at least a portion of an exterior surface of the ball, and the bladder is located within the casing. The bladder includes a pocket that projects toward a center of the sport ball, and the pocket defines a cavity. The component, which may be an electronic device or a counterweight, is located within the pocket. In some configurations, the bladder may include a valve that is located on an opposite side of the bladder from the pocket and component.

20 Claims, 17 Drawing Sheets

(56) References Cited

U.S. PATENT DOCUMENTS

| | | | | |
|---|---|---|---|---|
| 2004/0162170 | A1* | 8/2004 | Ng | 473/571 |
| 2006/0135297 | A1* | 6/2006 | Cruciani | 473/570 |
| 2007/0021244 | A1* | 1/2007 | Ko | 473/570 |
| 2008/0132363 | A1* | 6/2008 | Harada | 473/570 |
| 2010/0130314 | A1* | 5/2010 | Von Der Gruen et al. | 473/570 |
| 2010/0130315 | A1* | 5/2010 | Steidle | 473/570 |
| 2011/0218065 | A1 | 9/2011 | Cavallaro et al. | |
| 2011/0304497 | A1 | 12/2011 | Molyneux et al. | |
| 2014/0221137 | A1* | 8/2014 | Krysiak et al. | 473/570 |
| 2015/0196811 | A1* | 7/2015 | Laurienzo et al. | A63B 43/06 |

* cited by examiner

SPORT BALL BLADDER WITH A POCKET

BACKGROUND

A variety of inflatable sport balls (e.g., soccer balls, footballs, basketballs) conventionally incorporate a layered structure that includes a casing, a restriction structure, and a bladder. The casing forms an exterior layer of the sport ball and is generally formed from a durable, wear-resistant material. In soccer balls and footballs, for example, the panels may be joined together along abutting edges (e.g., with stitching or adhesives). In basketballs, for example, the panels may be secured to the exterior surface of a rubber covering for the restriction structure and bladder. The restriction structure forms a middle layer of the sport ball and is positioned between the bladder and the casing to restrict expansion of the bladder. The bladder, which generally has an inflatable configuration, is located within the restriction structure to provide an inner layer of the sport ball. In order to facilitate inflation (i.e., with air), the bladder generally includes a valved opening that extends through each of the restriction structure and casing, thereby being accessible from an exterior of the sport ball.

SUMMARY

A sport ball may include a casing, a bladder, and a component. The casing forms at least a portion of an exterior surface of the ball, and the bladder is located within the casing. The bladder includes a pocket that projects toward a center of the sport ball, and the pocket defines a cavity. The component, which may be an electronic device or a counterweight, is located within the pocket. In some configurations, the bladder may include a valve that is located on an opposite side of the bladder from the pocket and component.

A method of manufacturing a bladder for a sport ball may include providing a mandrel having a protrusion that forms an end portion of the mandrel. The mandrel, including the protrusion, are coated with a barrier material. Upon drying, solidifying, or curing, the barrier material is removed from the mandrel and a valve is secured to the barrier material.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of sport balls, including a soccer ball, a football for American football, and a basketball. The concepts discussed herein may, however, be applied to a variety of other sport balls having inflatable or gas-retaining configurations, including footballs for rugby, volleyballs, and water polo balls, for example. Accordingly, the concepts discussed herein apply to a variety of sport ball configurations.

Sport Ball Configuration

Figure 1:
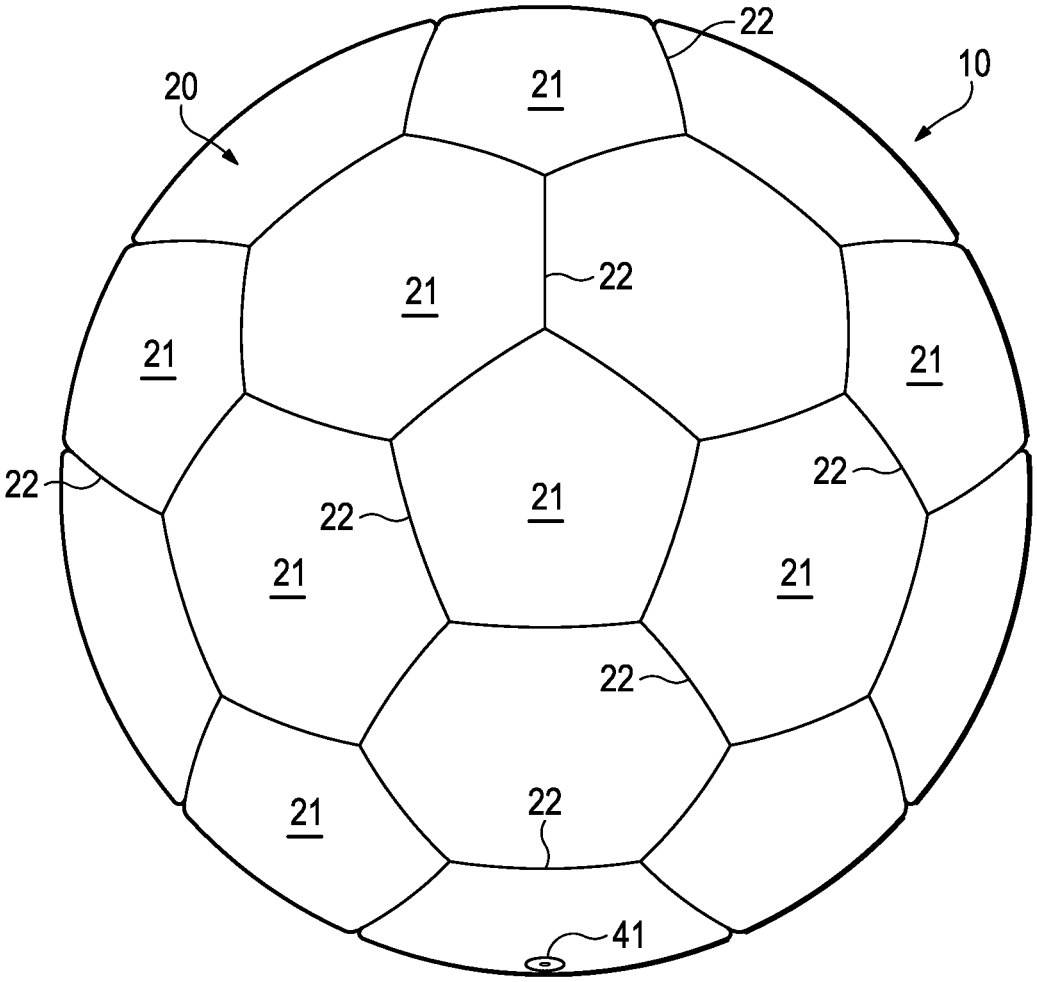
FIG. 1 is a perspective view of a sport ball.
Figure 2:
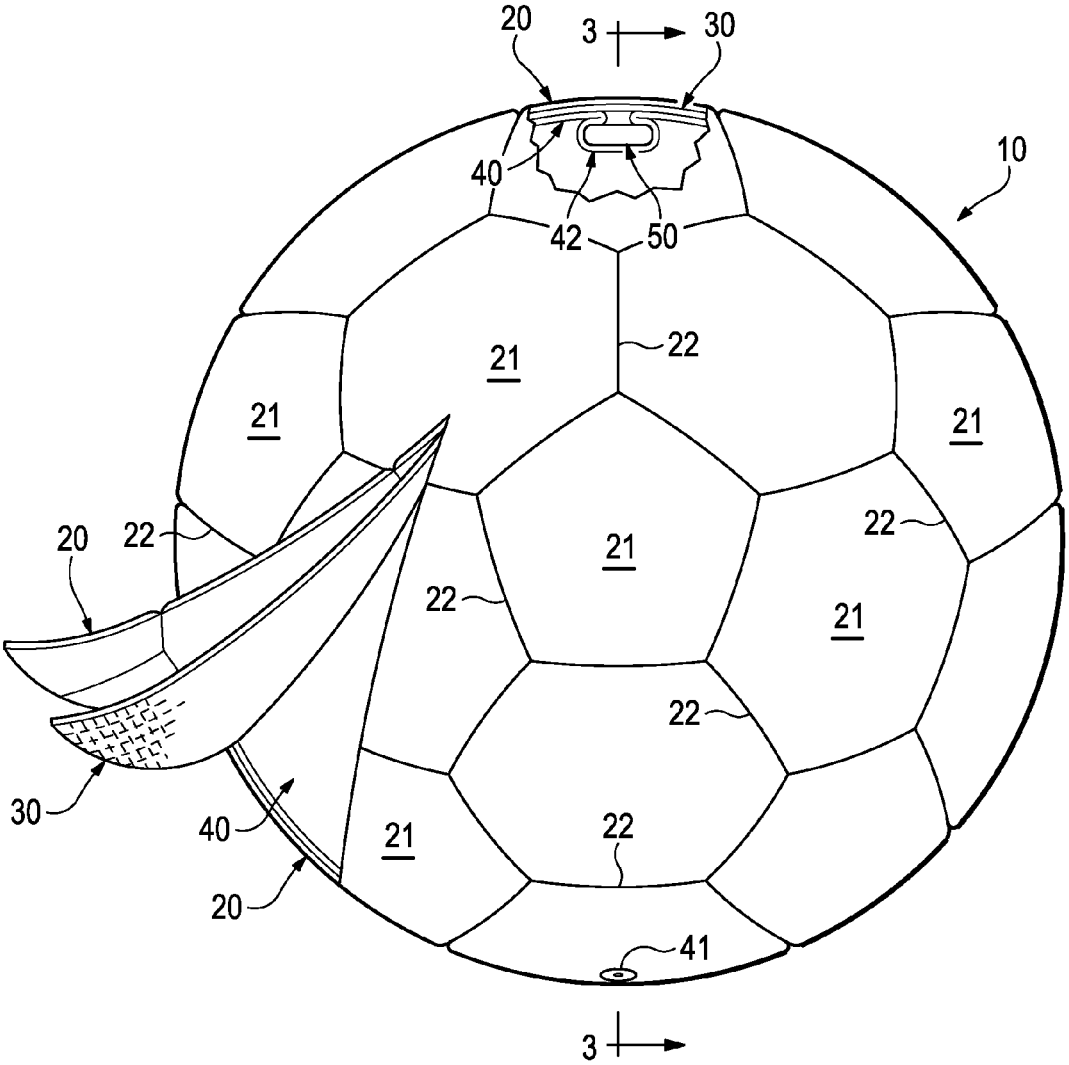
FIG. 2 is another perspective view of the sport ball.
Figure 3:
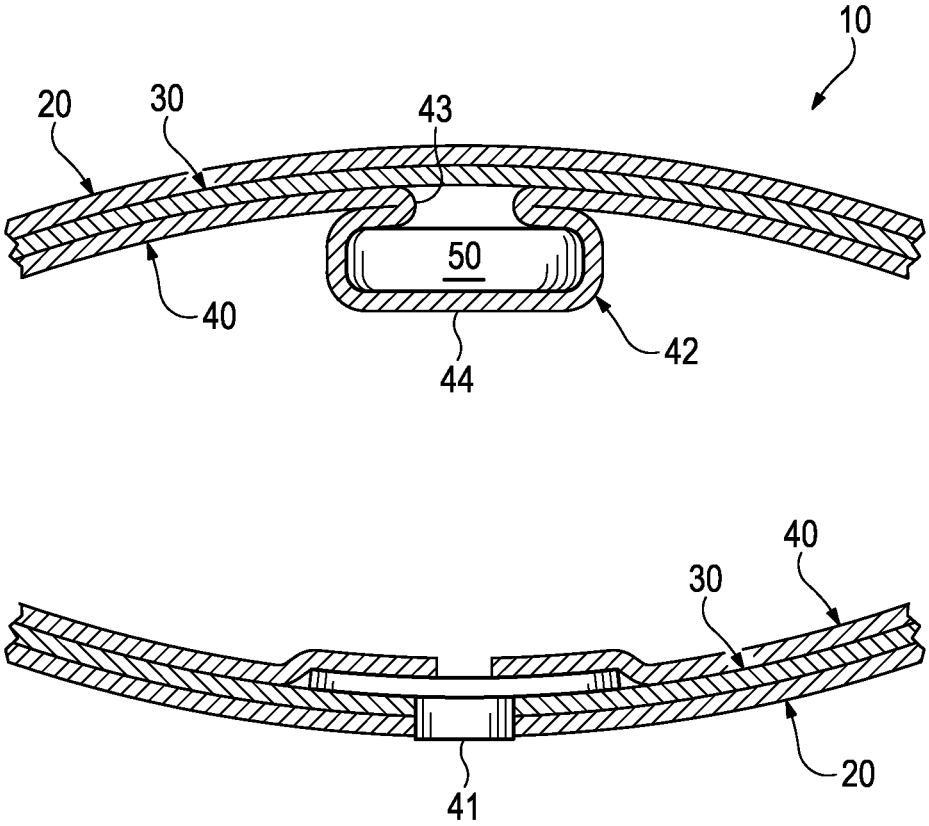
FIG. 3 is a cross-sectional view of the sport ball, as defined in FIG. 2.

A sport ball 10 having the configuration of a soccer ball is depicted in FIGS. 1-3. Sport ball 10 has a layered structure that includes a casing 20, a restriction structure 30, and a bladder 40. In addition, sport ball 10 includes an component 50, which may be an electronic device, a counterweight, or both, for example. As described in greater detail below, component 50 is securely-located within a pocket, cavity, indentation, void, or other space that is formed in bladder 40.

Casing 20 forms an exterior of sport ball 10 and is includes various panels 21 that are stitched, adhered, bonded, welded, or otherwise joined together along abutting sides or edges to form a plurality of seams 22. Panels 21 are depicted as having the shapes of equilateral pentagons or hexagons. In other configurations of sport ball 10, however, panels 21 may have non-equilateral shapes, non-regular or non-geometrical shapes, or a variety of other shapes (e.g., triangular, square, rectangular, trapezoidal, round, oval) that combine in a tessellation-type manner to form casing 20. Each of panels 21 may also be formed to have hexagonal shapes. Although sides of panels 21 may be linear, panels 21 may also have concave, convex, or otherwise non-linear edges. Selected panels 21 may be integral with adjacent panels 21 to form bridged panels that reduce the number of seams 22. In further configurations, casing 20 may have a seamless structure (i.e., where all of seams 22 are absent). Accordingly, the construction of casing 20 may vary significantly to include a variety of configurations for panels 21.

The materials selected for casing 20, or individual panels 21, may be leather, synthetic leather, polyurethane, polyvinyl chloride, rubber, or other materials that are generally durable and wear-resistant. In some configurations, each of panels 21 may have a layered configuration that combines two or more materials. For example, each panel 21 may include a non-foamed polymer layer and a polymer foam layer. As another example, an exterior portion of each panel 21 may be polyvinyl chloride layer, a middle portion of each panel 21 may be a polymer foam layer, and an interior portion of each panel 21 may be a textile layer.

Restriction structure 30 forms a middle layer of sport ball 10 and is positioned between casing 20 and bladder 40. In general, restriction structure 30 is formed from materials with a limited degree of stretch in order to restrict expansion of bladder 40, but may have a variety of configurations or purposes. As examples, restriction structure 30 may be formed from (a) a thread, yarn, or filament that is repeatedly wound around bladder 40 in various directions to form a mesh that covers substantially all of bladder 40; (b) a plurality of generally flat or planar textile elements stitched together to form a structure that extends around bladder 40; (c) a plurality of generally flat or planar textile strips that are impregnated with latex and placed in an overlapping configuration around bladder 40; or (d) a substantially seamless spherically-shaped textile. In some configurations of sport ball 10, restriction structure 30 may also be bonded, joined, or otherwise incorporated into either of casing 20 and bladder 40, or restriction structure 30 may be absent from sport ball 10. Accordingly, the construction of restriction structure 30 may vary significantly to include a variety of configurations and materials.

Bladder 40 has an inflatable configuration and is located within restriction structure 30 to provide an inner portion of sport ball 10. When inflated, bladder 40 exhibits a rounded or generally spherical shape. In order to facilitate inflation, bladder 40 includes a valve 41 that extends through restriction structure 30 and casing 20, thereby being accessible from an exterior of ball 10. In other configurations, bladder 40 may have a valveless structure that is semi-permanently inflated. Bladder 40 may be formed from a rubber or carbon latex material that substantially prevents air or other fluids within bladder 40 from diffusing to the exterior of ball 10. In addition to rubber and carbon latex, a variety of other polymer or elastomeric (i.e., stretchable) materials may be utilized for bladder 40.

Component 50 is located within a pocket 42 that is formed in bladder 40 and may be an electronic device, a counterweight, or both of an electronic device and a counterweight. As an electronic device, component 50 may include a microprocessor, transmitter, receiver, memory, battery, or other combination of elements that process, send, receive, or collect data. More specifically, examples of electronic devices that are suitable for component 50 include one or more of (a) a sensor for determining a pressure of the fluid within bladder 40; (b) a global positioning system (i.e., GPS) unit or an accelerometer that measures various factors relating to the location or movement of sport ball 10, including acceleration, spin, velocity, elevation, and direction; (c) a line sensor that determines whether sport ball 10 has crossed a goal line or an out-of-bounds line; (d) a radio-frequency identification (i.e., RFID) chip that stores data relating to sport ball 10 or assists with identifying sport ball 10; and a camera that collects image data. As a counterweight, component 50 may enhance the balance, weight distribution, center of mass, or other properties of sport ball 10. More specifically, component 50 may be any object that acts as a counterweight. In many configurations, however, component 50 may be an electronic device that adds the advantage of being a counterweight.

The pressurization of bladder 40 with air or another fluid induces sport ball 10 to take on a substantially spherical shape. More particularly, fluid pressure within bladder 40 causes bladder 40 to place an outward force upon restriction structure 30. In turn, restriction structure 30 places an outward force upon casing 20. In order to limit the expansion of bladder 40 and also limit the tension in casing 20, restriction structure 30 is generally formed from a material that has a limited degree of stretch. In other words, bladder 40 places an outward force upon restriction structure 30, but the stretch characteristics of restriction structure 30 effectively prevent the outward force from inducing significant tension in casing 20. Accordingly, restriction structure 30 may be utilized to restrain pressure from bladder 40, while permitting outward forces from bladder 40 to induce a substantially spherical shape in casing 20, thereby imparting a substantially spherical shape to sport ball 10.

Bladder Pocket

Pocket 42 provides a cavity, indentation, void, or other space that receives component 50. When bladder 40 is incorporated into sport ball 10, pocket 42 protrudes or projects inward and toward a center of sport ball 10, as depicted in FIGS. 2 and 3, thereby locating component 50 within an interior area of sport ball 10. In this position, component 50 is protected from impacts with a foot, surface, or other object when sport ball 10 is being utilized.

Figure 4:
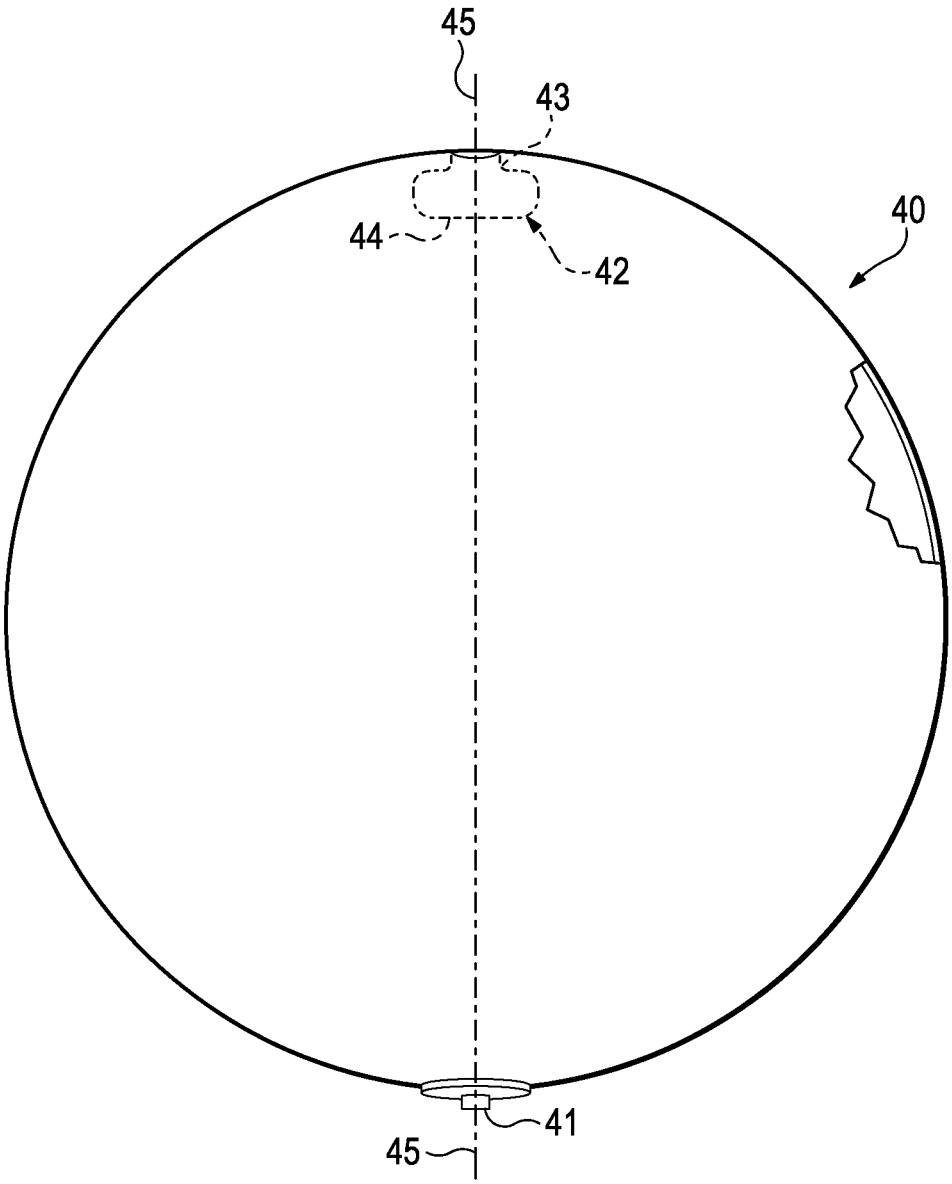
FIG. 4 is a perspective view of a bladder of the sport ball.
Figure 5:
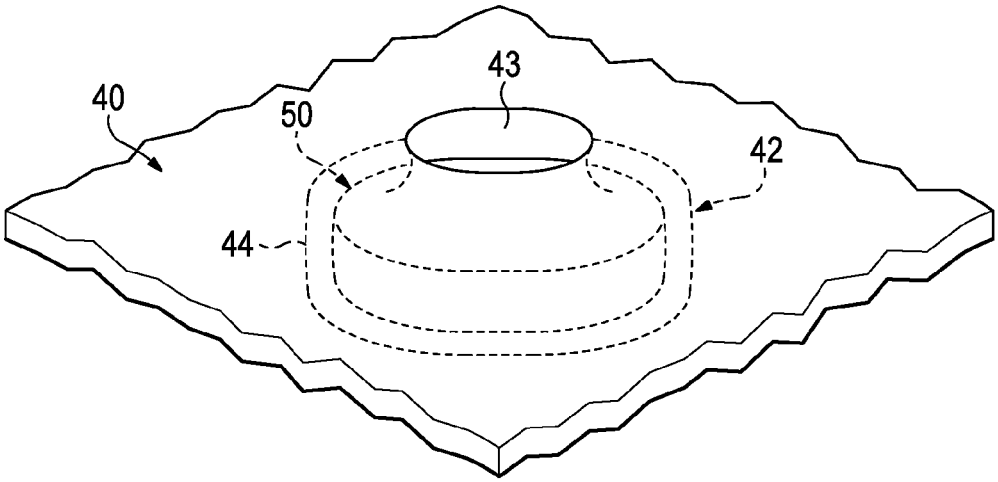
FIG. 5 is a perspective view of a portion of the bladder and an electronic component located within a pocket in the bladder.
Figure 6:
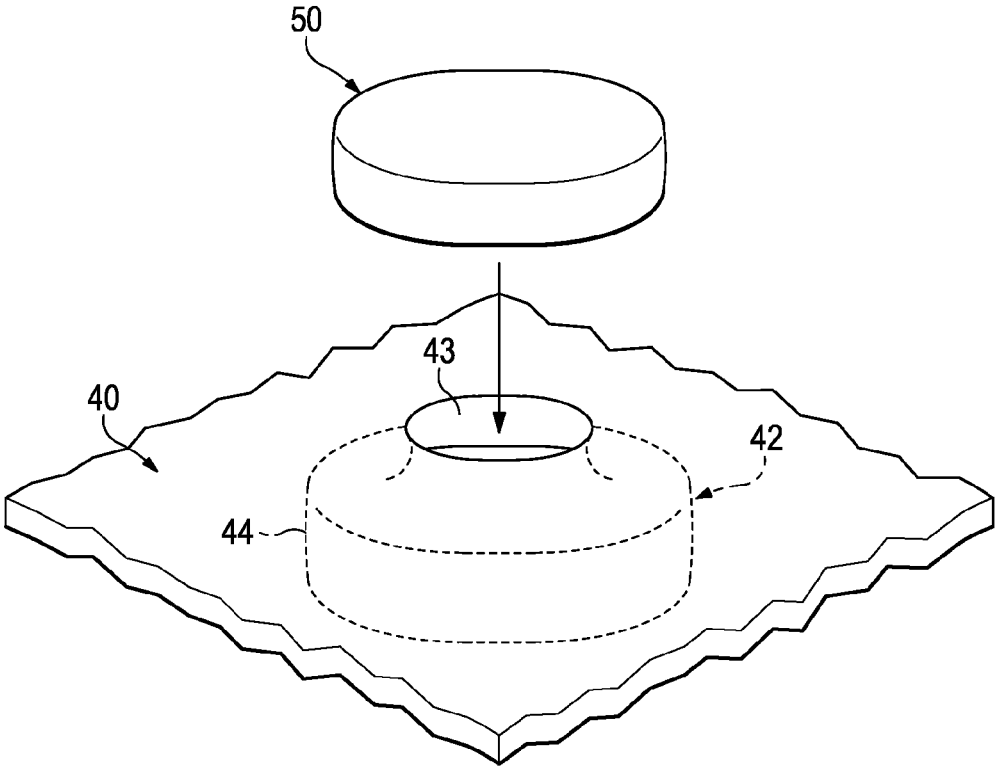
FIG. 6 is an exploded perspective view of the portion of the bladder and the electronic component.

The shape and size of pocket 42 accommodates component 50. That is, the configuration of pocket 42 may be selected to form a cavity that receives component 50 and securely-retains component 50 within sport ball 10. Referring to FIGS. 4-6, pocket 42 includes a neck portion 43 and a container portion 44. Whereas neck portion 43 forms an opening to the cavity that receives component 50, container portion 44 forms the cavity. In comparison, a width of neck portion 43 is less than a width of container portion 44 and the cavity formed by container portion 44. Similarly, the width of the opening formed by neck portion 43 is less than the width of container portion 44. This configuration has an advantage of ensuring that component 50 is securely-retained within pocket 42. More particularly, component 50 may be larger than neck portion 43 to fill or otherwise fit within the cavity in container portion 44. Given that component 50 is larger than the opening formed by neck portion 43, component 50 remains within the cavity due to size constraints. In manufacturing sport ball 10, however, an individual or machine may insert component 50 into pocket 42 by stretching or otherwise distending neck portion 43.

By forming neck portion 43 to have lesser width than container portion 44, pocket 42 effectively wraps around component 50 and contacts opposite surfaces of component 50. More particularly, one surface of component 50 faces away from the center of sport ball 10, whereas the other surface of component 50 faces toward the center of sport ball 10. In addition to contacting edge areas of component 50, container portion 44 extends around component 50 to contact and lay against both surfaces of component 50. This configuration also provides the advantage of ensuring that component 50 is securely-retained within pocket 42.

As noted above, component 50 may be a counterweight that enhances the balance, weight distribution, center of mass, or other properties of sport ball 10. Referring to FIG. 4, for example, valve 41 is located opposite pocket 42. That is, valve 41 and pocket 42 are located on opposite sides of bladder 40 and on an axis 45 that extends through a center of bladder 40. Valve 41 adds mass to one side of sport ball 10, and the combination of pocket 42 and component 50 adds mass to an opposite side of sport ball 10. By equalizing these masses, sport ball 10 achieves better balance than in the absence of pocket 42 and component 50. In practice, however, these masses may not be equal. The balance and other properties of sport ball 10 may, however, be enhanced when a combination of the mass of pocket 42 and component 50 is in a range of 75 percent to 125 percent of the mass of valve 41. Accordingly, the mass of sport ball 10 may be more evenly distributed and the center of gravity of sport ball 10 may be more centrally-located when valve 41 and component 50 are located on opposite sides of sport ball 10 and along a common axis (i.e., axis 45).

Figure 7:
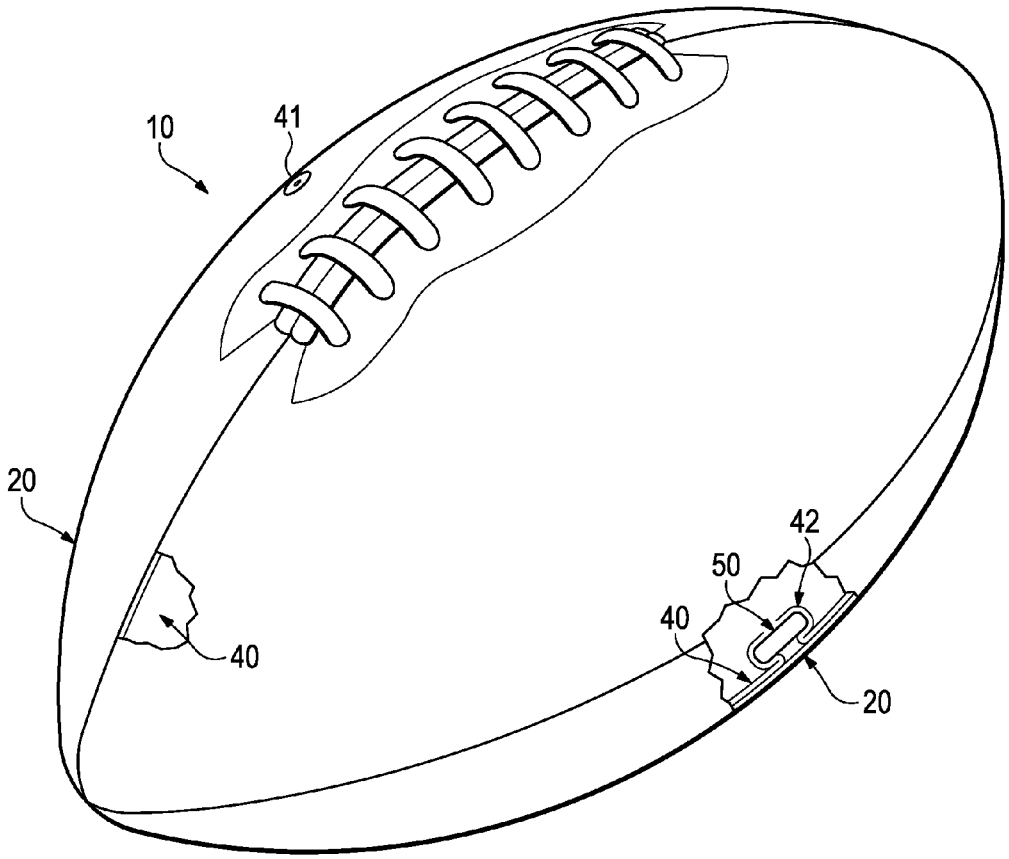
FIGS. 7 and 8 are perspective views of further configurations of the sport ball.
Figure 8:
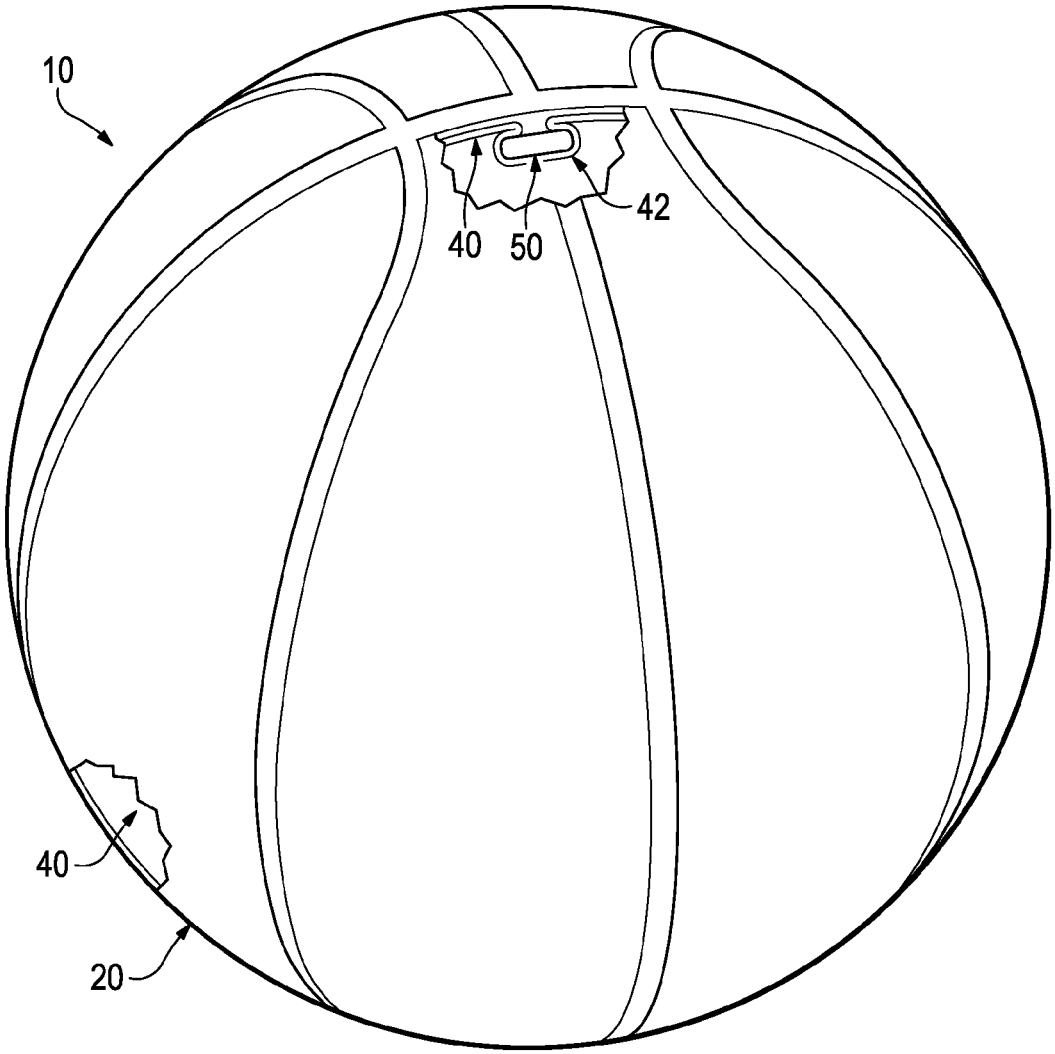

The configuration discussed above provides an example of the structure of sport ball 10, as well as pocket 42. Referring to FIGS. 7 and 8, sport ball 10 is respectively depicted as having the configurations of a football for American football and a basketball. In each of these configurations, bladder 40 forms pocket 42 and includes component 50. Although a single component 50 may be incorporated into sport ball 10, bladder 40 may include multiple pockets 42, each of which may include a component 50. The relative dimensions between portions 43 and 44 may also vary. Accordingly, various aspects of sport ball 10 and pocket 42 may vary, depending upon the athletic activity that sport ball 10 is intended to be used during and the configuration and purpose of component 50, for example.

Based upon the above discussion, sport ball 10 includes casing 20, restriction structure 30, bladder 40, and component 50. Bladder 40 is located within casing 20 and restriction structure 30 and includes pocket 42, which projects toward a center of sport ball 10. Pocket 42 has both neck portion 43 and container portion 44. Whereas container portion 44 forms the cavity within pocket 42, neck portion 43 forms an opening to the cavity. Although the configuration of pocket 42 may vary considerably, a width of the opening may be less than a width of the cavity. Moreover, valve 41 may be located on an opposite side of bladder 40 from pocket 42.

Manufacturing Process

Figure 9A:
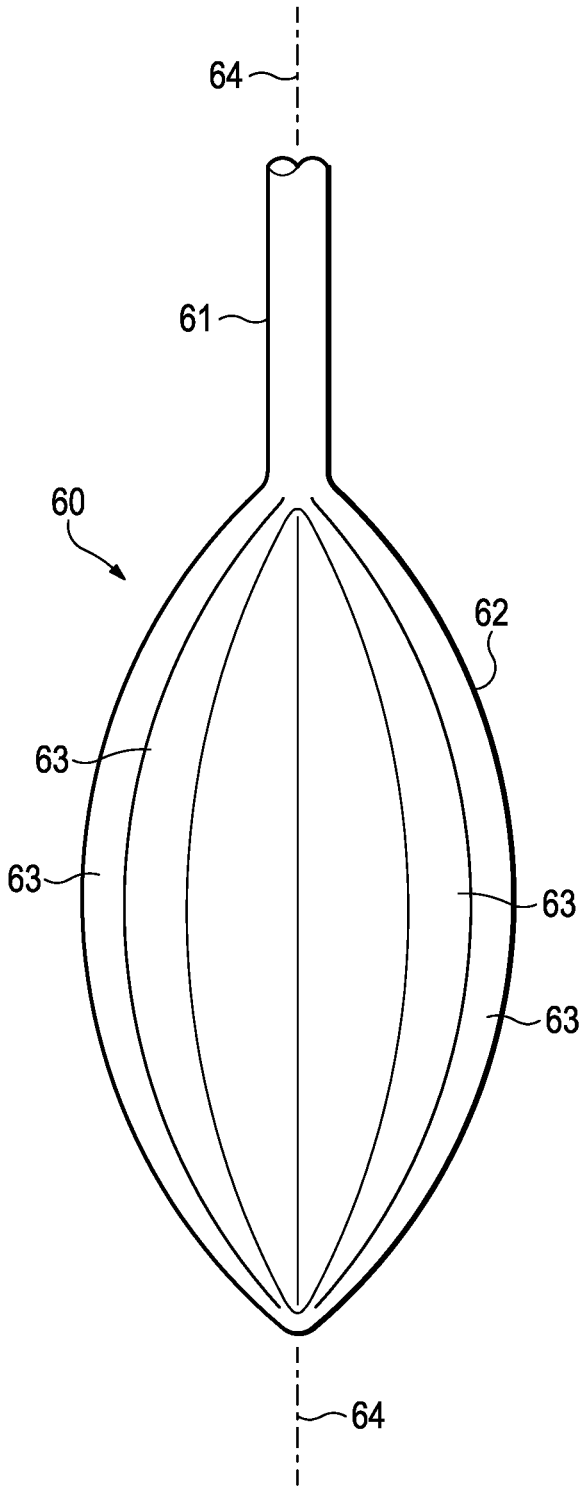
FIGS. 9A-9J are perspective views of a process for manufacturing the bladder.

Although bladder 40 takes on a substantially spherical shape when incorporated into sport ball 10 and inflated, bladder 40 may be formed to have various wings that expand to the substantially spherical shape. Referring to FIG. 9A, a conventional mandrel 60 is depicted as including a support 61 and a forming surface 62 with various wings 63 that extend outward from a central axis 64. In manufacturing a conventional bladder, forming surface 62 is coated with a barrier material (e.g., rubber or carbon latex). Once removed from mandrel 60, a valve is secured to the barrier material and manufacture of the bladder is substantially complete.

Figure 9B:
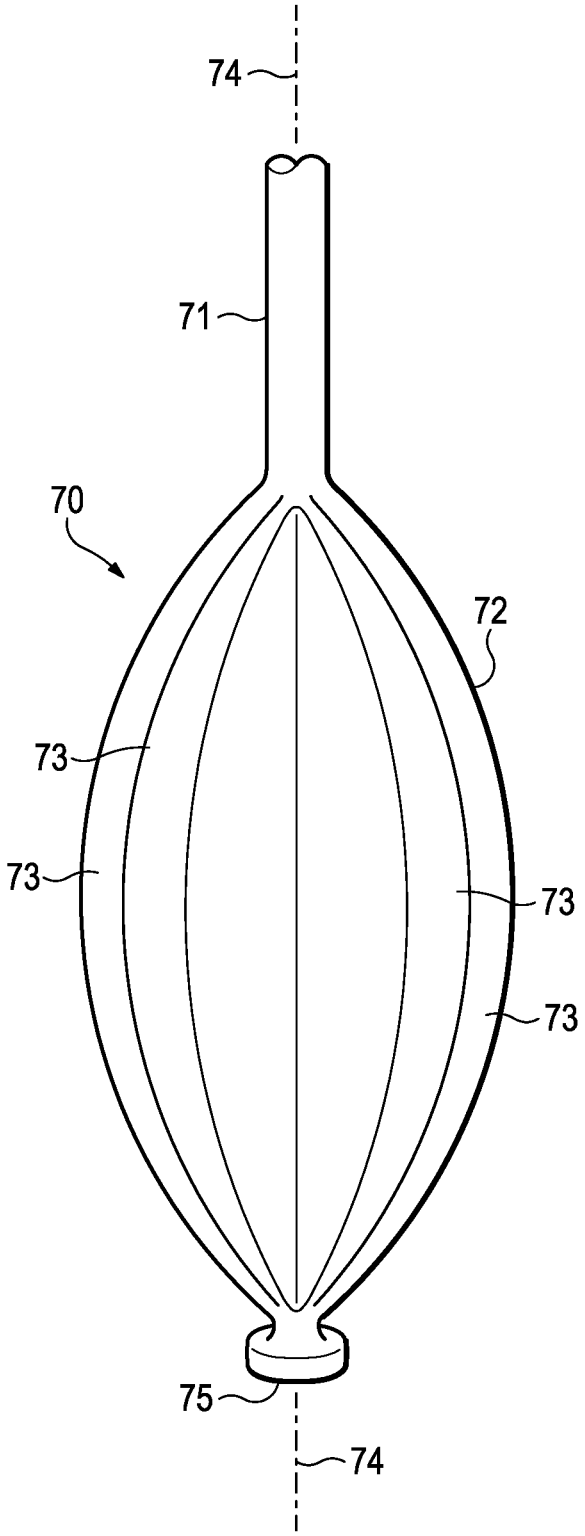

A modified mandrel 70, which is depicted in FIG. 9B, is utilized in the manufacturing process for bladder 40. Similar to mandrel 60, mandrel 70 includes a support 71 and a forming surface 72 with various wings 73 that extend outward from a central axis 74. Although mandrel 70 may include four wings 73, some configurations may include three, five, or six wings 73. In further configurations, mandrel 70 may have a generally spherical or elongated shape without wings 73.

Mandrel 70 includes a protrusion 75 that is located opposite support 71 and on axis 74. In this position, protrusion 75 forms an end portion of mandrel 70. As discussed in greater detail below, protrusion 75 forms pocket 42 in bladder 40. Although techniques may vary, mandrel 70 may be formed by retrofitting a conventional mandrel (e.g., mandrel 60) with protrusion 75. Alternately, mandrel 70 may be formed specifically for the manufacture of bladder 40 by including protrusion 75. Given that protrusion 75 forms pocket 42, a shape of protrusion 75 may be selected to correspond with the shape of component 50. Given that different components 50 may have different shapes, the configuration of protrusion 75 may vary to correspond with the different shapes. Alternately, protrusion 75 may have a general shape that forms pocket 42 to have a configuration that accommodates multiple shapes for components 75.

Figure 9C:
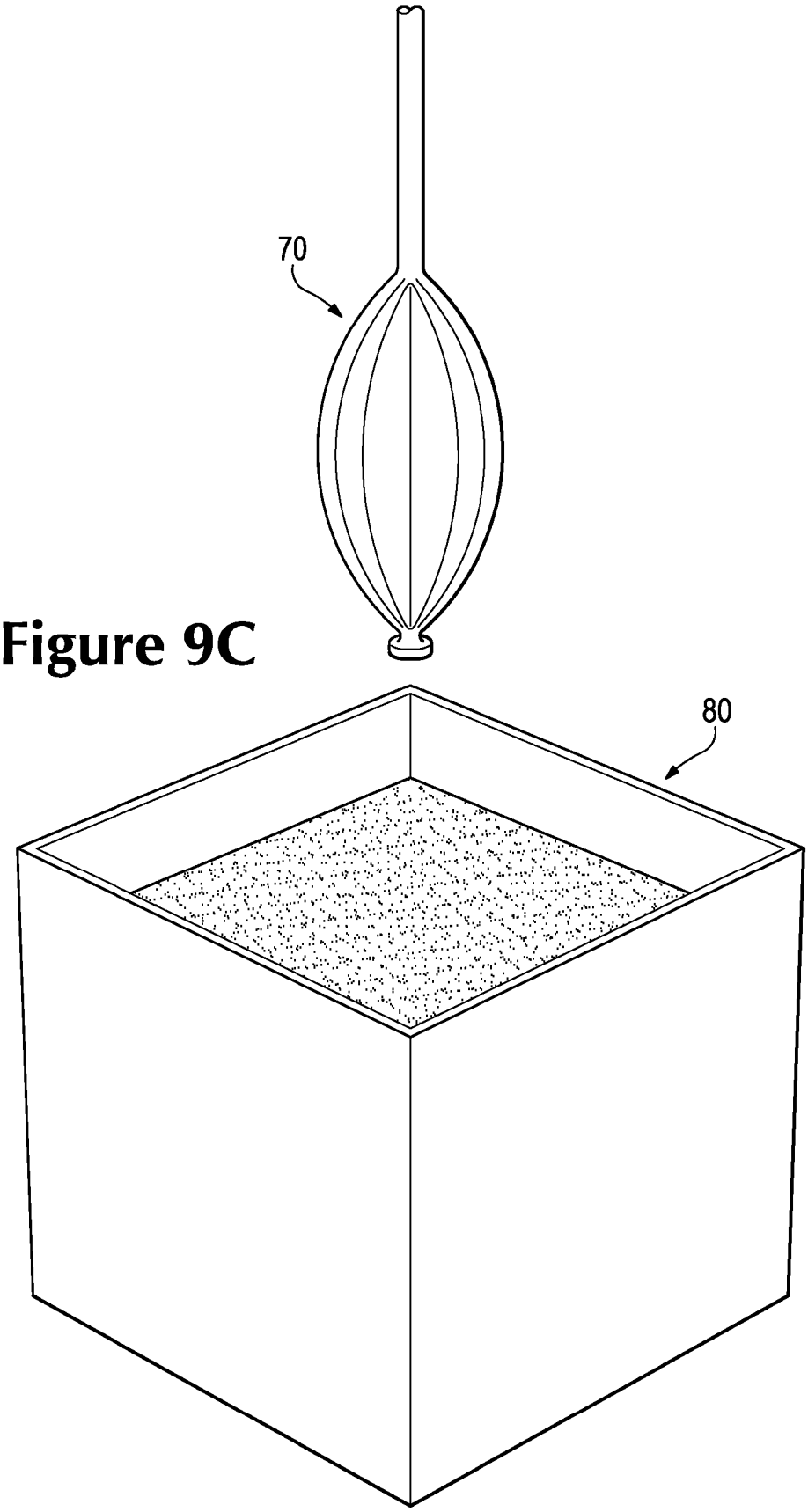
Figure 9D:
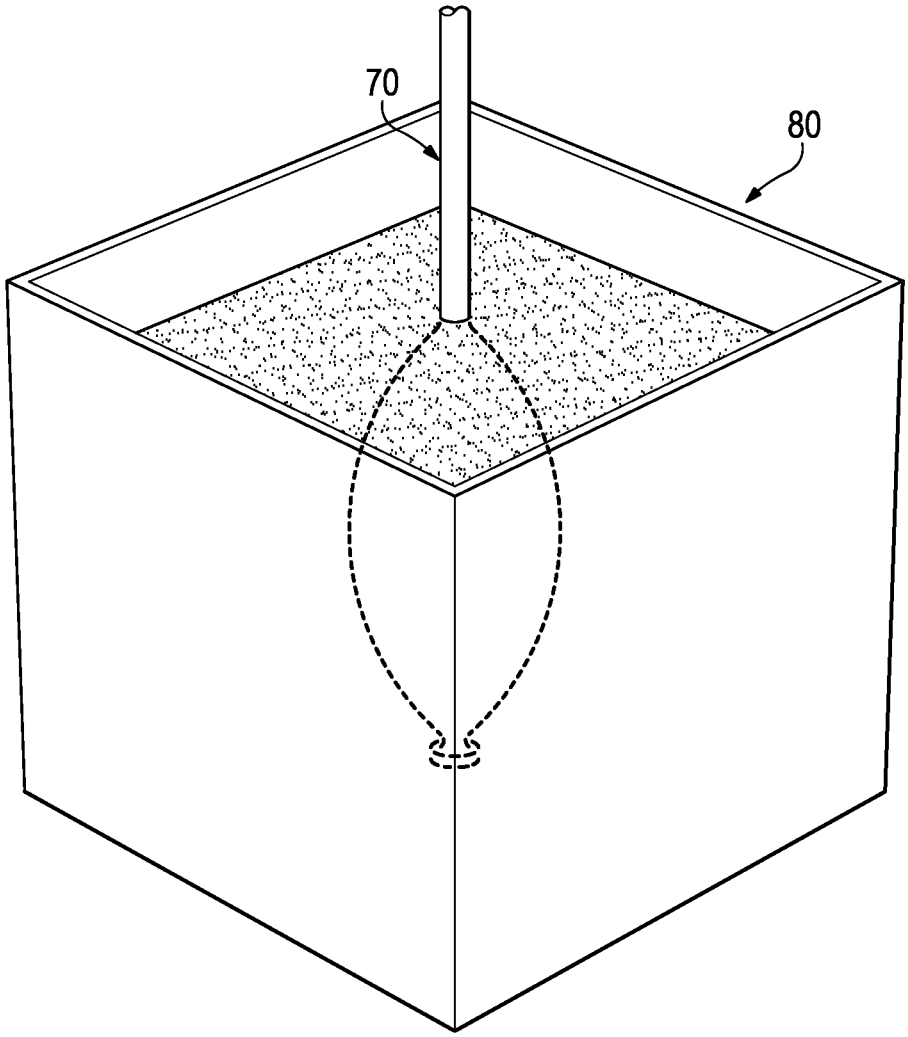
Figure 9E:
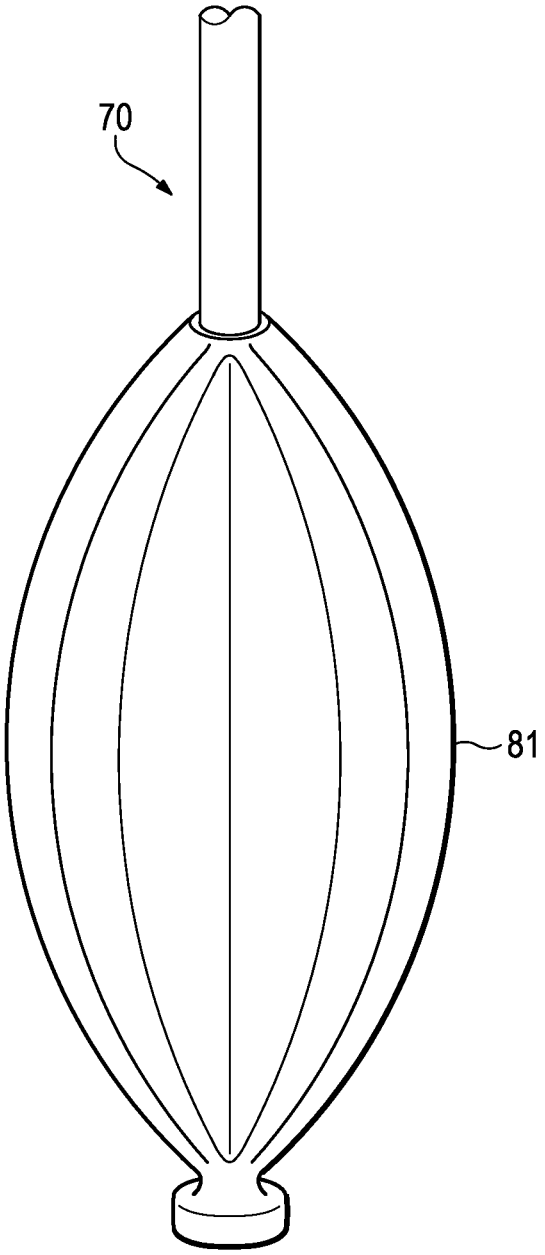

The barrier material that forms bladder 40 may be applied to mandrel 70 in various ways. As an example, FIG. 9C depicts mandrel 70 as being adjacent to a vat 80, which holds molten barrier material or a resin for the barrier material. Mandrel 70 is then dipped or immersed in the molten or uncured barrier material, as depicted in FIG. 9D, to coat wings 73 and protrusion 75 with the barrier material. Mandrel 70 and a layer 81 of barrier material are then removed from vat 80, as depicted in FIG. 9E. In effect, layer 81 covers and adheres to forming surface 72.

Figure 9F:
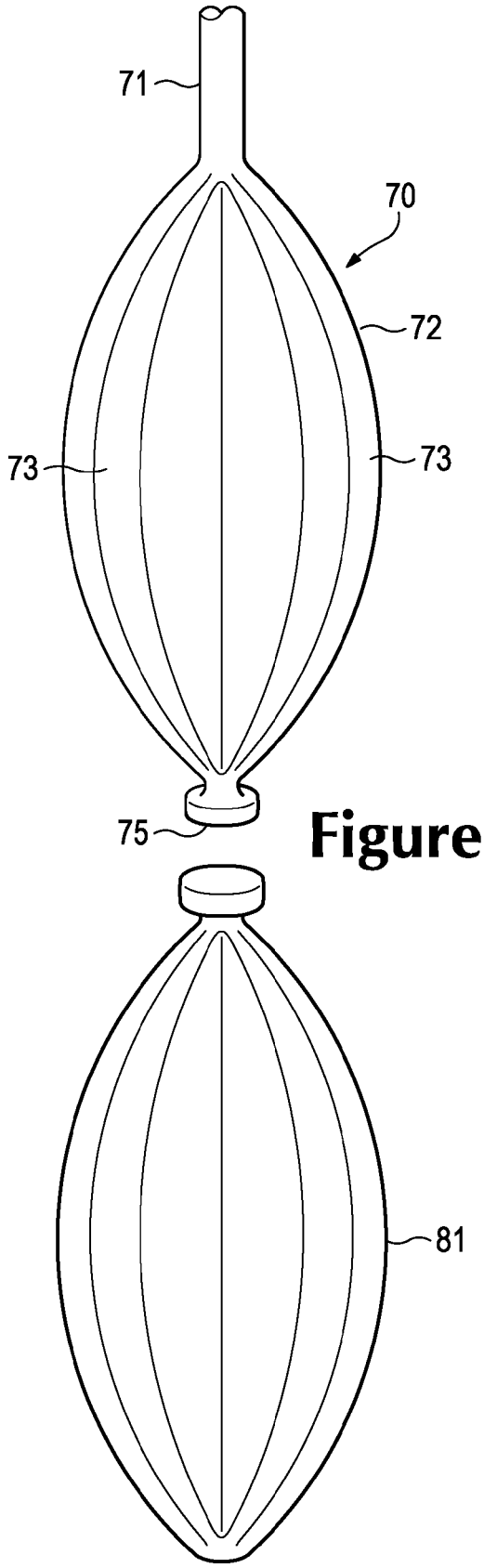
Figure 9G:
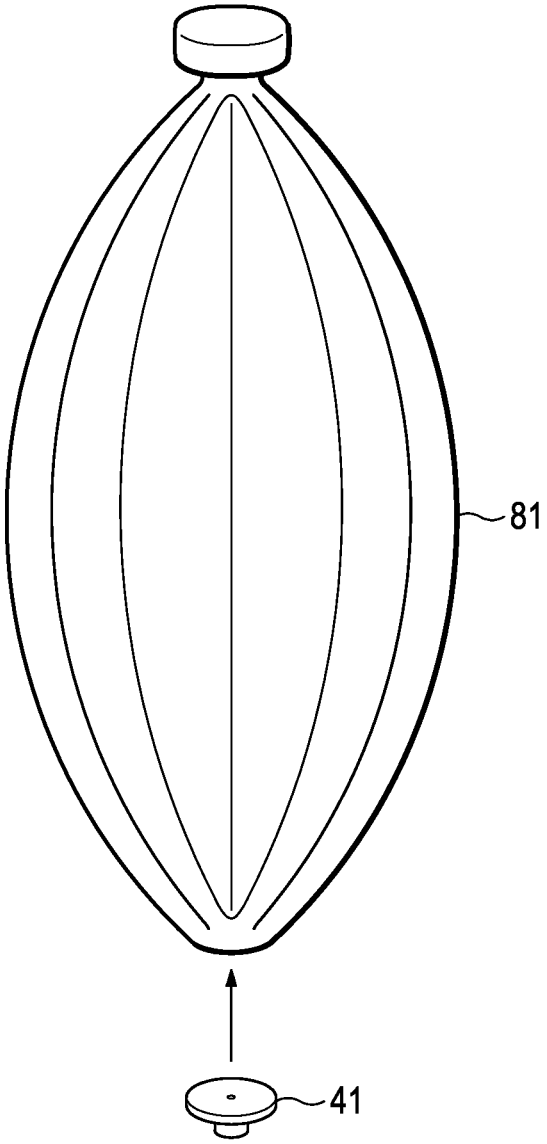
Figure 9H:
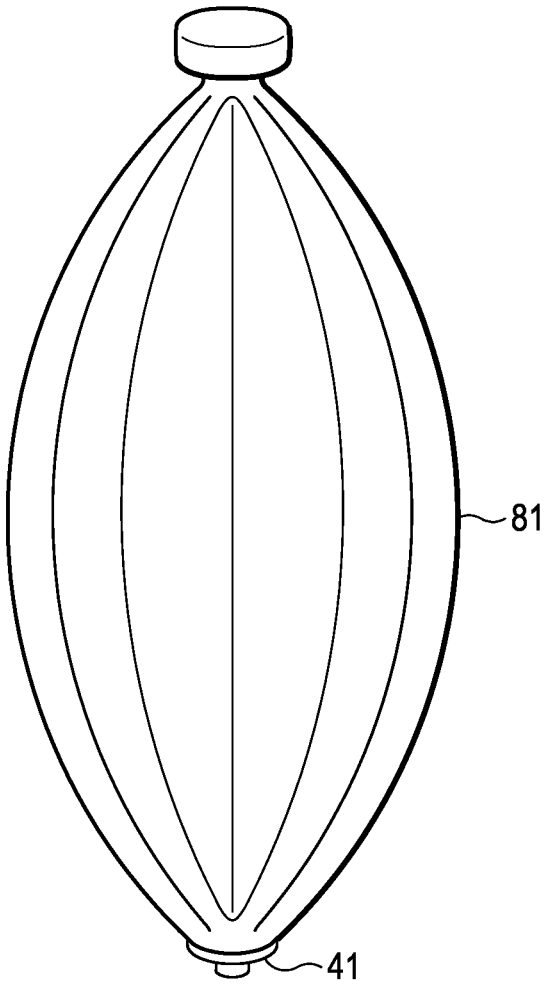
Figure 9I:
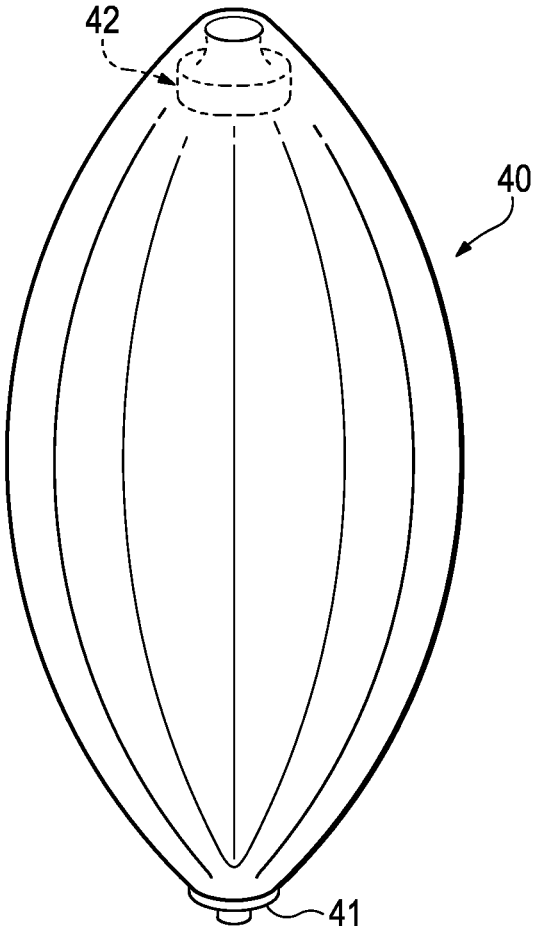
Figure 9J:
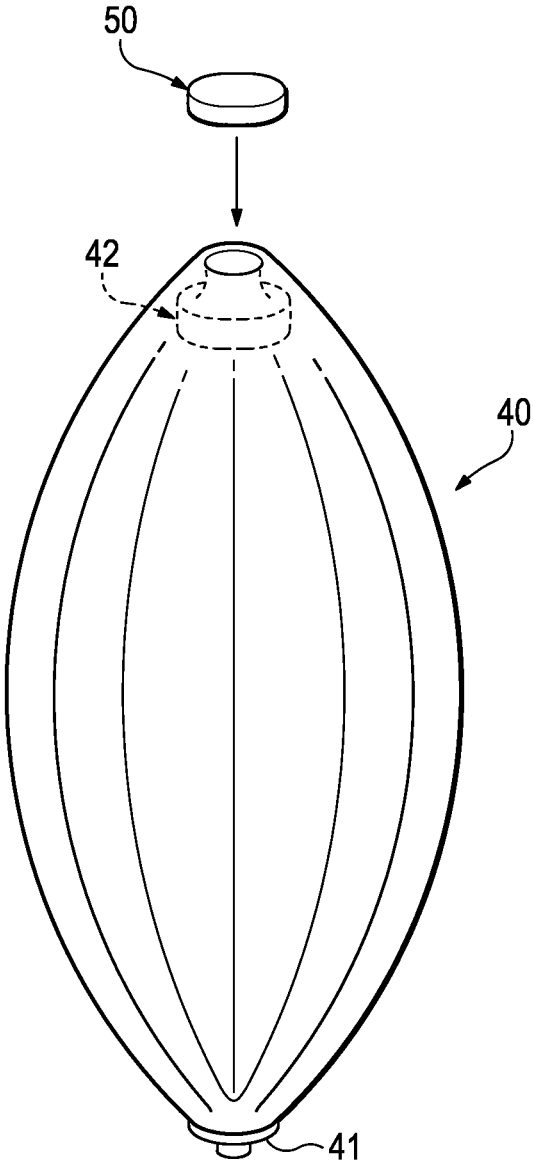

Once layer 81 dries, solidifies, or cures, layer 81 may be stripped, pulled off, or otherwise removed from mandrel 70, as depicted in FIG. 9F. At this stage, layer 81 has many of the characteristics of bladder 40, except that valve 41 is absent and the portion of layer 81 that forms pocket 42 protrudes outward. Valve 41 is then adhered or joined to layer 81, as depicted in FIGS. 9G and 9H, through conventional means. In order to substantially complete the manufacture of bladder 40, the end area of layer 81 may be pushed into bladder 40, as depicted in FIG. 91, to form pocket 42. Moreover, component 50 may be inserted into pocket 42, as depicted in FIG. 9J, and the combination of bladder 40 and component 50 may be incorporated into sport ball 10.

The general manufacturing process discussed above, forms pocket 42 as a shaped portion of the bladder. That is, a portion of bladder 40 is specifically shaped to include a structure that forms pocket 42. More particularly, mandrel 70 is formed to include protrusion 75, which is present for the specific purpose of forming pocket 42 in bladder 40. Pocket 42 is not, therefore, a feature that arises due to the presence of component 50 and the outward pressure of the fluid within bladder 40. Rather, portions of bladder 40 are shaped during manufacturing to provide a structure in bladder 40 that forms pocket 42.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A sport ball comprising:

a casing that forms at least a portion of an exterior surface of the ball;

a bladder located within the casing, the bladder having a radially outward-facing surface oriented facing away from a center of the ball, and a radially inward-facing surface facing toward the center of the ball, the bladder including a pocket that projects toward the center of the sport ball, the pocket having an inner surface defining a cavity and an outer surface opposite the inner surface and contiguous with an inner surface of adjacent portions of the bladder; and an electronic device located within the pocket;

wherein the pocket includes a neck portion and a container portion, the neck portion forming an opening to the cavity, and the container portion forming the cavity;

wherein the outer surface of the pocket has a neck width in the neck portion and a container portion width in the container portion; and wherein the neck width is smaller than the container portion width.

2. The sport ball recited in claim 1, wherein the electronic device is disposed radially inward of the radially-outward facing surface of the bladder.

3. The sport ball recited in claim 2, wherein a width of the opening is less than a width of the container portion.

4. The sport ball recited in claim 1, wherein the pocket is a shaped portion of the bladder.

5. The sport ball recited in claim 1, wherein the electronic device has (a) a first surface oriented to face away from the center of the sport ball and (b) a second surface oriented to face toward the center of the sport ball, and the pocket contacts both of the first surface and the second surface.

6. The sport ball recited in claim 1, wherein the bladder includes a valve, the pocket being located on an opposite side of the bladder from the valve.

7. The sport ball recited in claim 1, further including a restriction structure located between the casing and the bladder.

8. The sport ball recited in claim 1, wherein the electronic device includes at least one of a sensor, a global positioning system unit, an accelerometer, and a radio-frequency identification chip.

9. The sport ball recited in claim 1, wherein the electronic device performs at least one of processing, sending, receiving, and collecting data.

10. A sport ball comprising:

a casing that forms at least a portion of an exterior surface of the ball;

a bladder located within the casing, the bladder including a pocket and a valve, the pocket being a shaped portion of the bladder, and the pocket being located on an opposite side of the bladder from the valve; and a component located within the pocket;

wherein the pocket includes a container portion and a neck portion, the container portion forming a cavity within the pocket for holding the component, and the neck portion forming an opening to the cavity; and wherein the neck portion is formed by a folded portion of the bladder.

11. The sport ball recited in claim 10, wherein the component is an electronic device.

12. The sport ball recited in claim 10, wherein the component is a counterweight.

13. The sport ball recited in claim 10, wherein a combination of a mass of the pocket and the component is in a range of 75 percent to 125 percent of a mass of the valve.

14. The sport ball recited in claim 10, wherein a width of the opening is less than a width of the container portion.

15. A sport ball comprising:

a casing that forms at least a portion of an exterior surface of the ball;

a bladder located within the casing, the bladder including a pocket that projects toward a center of the sport ball, the pocket being a shaped portion of the bladder that has a container portion and a neck portion, the container portion forming a cavity within the pocket, and the neck portion forming an opening to the cavity, a width of the opening being less than a width of the cavity, and the bladder including a valve located on an opposite side of the bladder from the pocket; and a component located within the pocket;

wherein the casing is continuous across the opening to the cavity.

16. The sport ball recited in claim 15, wherein the component is an electronic device that includes at least one of a sensor, a global positioning system unit, an accelerometer, and a radio-frequency identification chip.

17. The sport ball recited in claim 15, wherein the component is a counterweight.

18. The sport ball recited in claim 15, further including a restriction structure located between the casing and the bladder.

19. The sport ball recited in claim 18, wherein the restriction structure is continuous across the opening to the cavity.

20. The sport ball recited in claim 15, wherein the bladder has a radially outward-facing surface oriented facing away from a center of the ball, and a radially inward-facing surface facing toward the center of the ball; and wherein the electronic device is disposed radially inward of the radially-outward facing surface of the bladder.

* * * * *